US006040286A

United States Patent [19]

Huff

[11] Patent Number: 6,040,286

[45] Date of Patent: Mar. 21, 2000

[54] THROUGH-THE-WASHER-DRYER POUCH-TYPE DETERGENT BAG AND METHOD OF USE

[76] Inventor: Karen L. Huff, 8215 Orchard Ave. #6, La Mesa, Calif. 91941

[21] Appl. No.: 08/910,548

[22] Filed: Dec. 26, 1995

[51] Int. Cl.[7] ..... C11D 17/04; B08B 3/00

[52] U.S. Cl. ..... 510/297; 510/439; 206/524.1; 206/524.3; 8/137

[58] Field of Search ..... 510/297, 439; 206/524.1, 524.3; 8/137

[56] References Cited

U.S. PATENT DOCUMENTS

| | | | |
|---|---|---|---|
| Re. 33,646 | 7/1991 | Klemm et al. | 510/297 |
| 2,470,851 | 5/1949 | Hermanson | 510/140 |
| 4,095,946 | 6/1978 | Jones et al. | 8/137 |
| 4,118,525 | 10/1978 | Jones | 427/242 |
| 4,170,565 | 10/1979 | Flesher et al. | 510/297 |
| 4,223,029 | 9/1980 | Mahler et al. | 427/242 |
| 4,259,373 | 3/1981 | Demessemaekers et al. | 427/242 |
| 4,555,354 | 11/1985 | Clarke et al. | 510/297 |
| 4,638,907 | 1/1987 | Bedenk et al. | 510/277 |
| 4,733,774 | 3/1988 | Ping et al. | 206/487 |
| 4,776,455 | 10/1988 | Anderson et al. | 206/0.5 |
| 4,828,746 | 5/1989 | Clauss et al. | 510/297 |
| 4,839,076 | 6/1989 | Willman et al. | 510/297 |
| 4,876,023 | 10/1989 | Dickenson et al. | 510/297 |
| 4,915,862 | 4/1990 | Beerse et al. | 510/297 |
| 5,002,681 | 3/1991 | Wierenga et al. | 510/297 |
| 5,110,640 | 5/1992 | Mack | 510/297 |
| 5,116,542 | 5/1992 | Carduck et al. | 510/297 |
| 5,132,036 | 7/1992 | Falou et al. | 510/297 |
| 5,160,654 | 11/1992 | Falou et al. | 510/277 |

*Primary Examiner*—Douglas J. McGinty
*Assistant Examiner*—Lorna M. Douyon

[57] ABSTRACT

A through-the-washer-dryer pouch-type detergent bag and method of use. The detergent bag is made of air and water permeable material and it has an interior chamber having a total volume V. A predetermined weight and volume of granular detergent particulate is deposited in said chamber. The volume of the detergent particulate is in a specific range and the remaining air volume of the chamber is also in a specific range. The pouch type detergent bag puffs up when it is dropped into water and air fills the unoccupied space of the chamber. As water permeates the interior chamber of the bag, the water dissolves the detergent and the detergent and air are forced out of the chamber causing the detergent bag to flatten and collapse. As the detergent bag continues through the wash cycle it curls up and becomes a wad of material.

6 Claims, 1 Drawing Sheet

H1
H2
H3
H5
H6
H7
L1
L2
W1
W2
T1

THROUGH-THE-WASHER-DRYER POUCH-TYPE DETERGENT BAG AND METHOD OF USE

BACKGROUND OF THE INVENTION

The invention relates to through-the-washer and dryer laundry products and more specifically one that contains a predetermined amount of detergent particulate.

Presently, when washing a load of clothes, the detergent must be measured and added at the start of the washing cycle. The detergent may be either in a liquid or granular form. The detergent that is added in this manner is often spilled or wasted on top of the washing machine, and cleaning is generally necessary.

A fabric softening and static control composition may be added at a different stage of the washing cycle or it may be added during the drying cycles. Several patents have been granted on methods and structures that allow fabric softening and static control compositions to be deposited into the clothes washing machine. The Jones U.S. Pat. No. 4,118,525 discloses a water-insoluble substrate carrying an intimate mixture of fabric softening and anti static compound in a dispersion inhibitor. This allows the laundry product that is added to the automatic washer to be subsequently transferred into the dryer with the wet clothes where it provides the fabric softening and static control benefits.

The Bedenk et al U.S. Pat. No. 4,638,907 discloses a multi-compartmentalized laminated laundry product that contains different powdered laundry products. The Ping et al U.S. Pat. No. 4,733,774 also discloses a through-the-wash and dryer laundry product that contains fabric softener material. The Clauss et al U.S. Pat. No. 4,828,746 pertains to coated particles of fabric softener which are included with detergent in the washing of fabrics. The particles survive the wash cycle and release softeners to the fabrics in a heated laundry dryer. The Wierenga et al U.S. Pat. No. 5,002,681 is directed to a pouch, detergent-compatible, through-the-wash, dryer-released, jumbo particulate fabric softening composition.

It is an object of the invention to provide a novel through-the-washer-dryer pouch-type detergent bag that is economical to manufacture and market.

It is another object of the invention to provide a much more effective pouch-type detergent bag that captures a predetermined amount of air in its inner chamber and allows detergent also contained in the chamber to slosh around therein as it dissolves in the water that has penetrated the detergent bag. This insures fast and complete dissolving of the detergent.

It is also an object of the invention to provide a much more effective pouch-type detergent bag having a unique shape.

It is an additional object of the invention to provide a novel pouch-type detergent bag that puffs up when it is dropped in water, then completely flattens out during agitation within the washing machine and later curls up into a wad of material that is transferred with the clothes into the dryer where the water softening/anti-static ingredients are activated and transferred to the clothes during the drying cycle.

SUMMARY OF THE INVENTION

The through-the-washer-dryer pouch-type detergent bag is preferably made from material that is air and water permeable. A good example of such a material is nonwoven polyester material. The detergent bag has a front panel and a rear panel and they are sealed together around their perimeter to form an inner chamber having a predetermined total volume $V_T$. Detergent particulate having a volume in the range of 0.40 $V_T$–0.70 $V_T$ is deposited in the chamber of the detergent bag. This allows a remaining volume in the range of 0.30 $V_T$–0.60 $V_T$ to be available for air.

When the detergent bag is dropped into the water of a washing machine, it puffs up with air filling the remainder of the chamber of the detergent bag that is not filled with detergent particulate. As the water permeates through the panel walls of the pouch, the water is allowed to slosh around within the chamber, mixing also with the air therein and allowing the detergent to be quickly and fully dissolved in the water. As the clothes washing machine continues to agitate the clothes and detergent bag, the dissolved detergent and air escapes through the porous side walls of the bag and the bag assumes a flattened shape. Further continued agitation causes the bag to curl into a wad of material. At this point the material of the bag still contains its water softener/anti-static ingredients. The clothes and the wadded detergent bag are then transferred into the clothes dryer where the heat in the dryer causes the fabric softener/anti-static ingredients to be released into the clothes.

The novel pouch-type detergent bag allows the detergent and fabric softener ingredients to be quickly and easily added to clothes to be washed in one simple operation. The measuring of detergent into the washing machine and the step of adding a fabric softenerg/anti-static agent to the washing cycle or the dryer has been eliminated.

DESCRIPTION OF THE PREFERRED EMBODIMENT

Figures 1, 2, 3, 4, 5, 6:
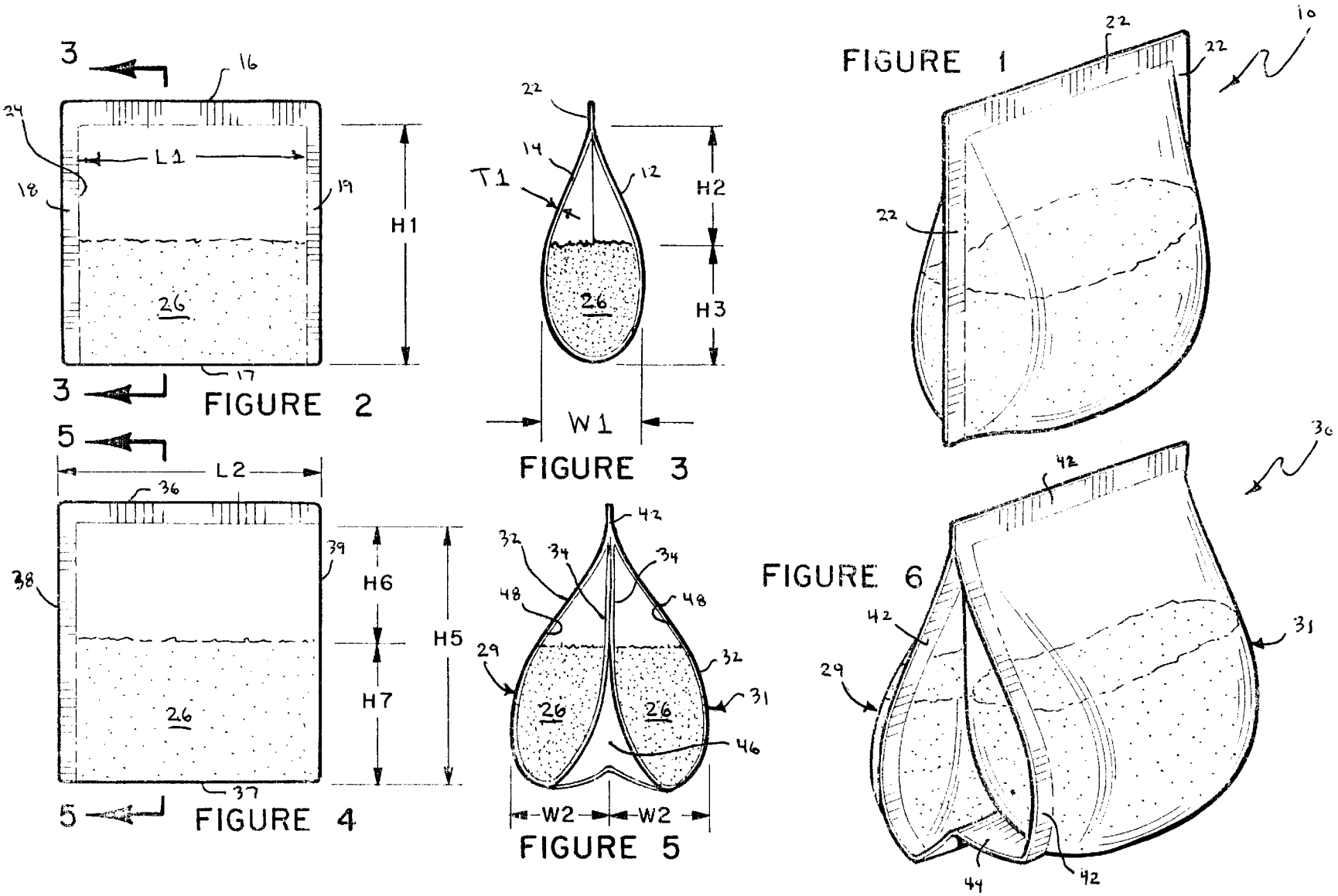
FIG. 1 is a front perspective view illustrating the novel pouch-type detergent bag.
FIG. 2 is a front elevation view of the pouch-type detergent bag.
FIG. 3 is a cross sectional view taken along lines 3—3 of FIG. 2.
FIG. 4 is a front elevation view of an alternative embodiment of the pouch-type detergent bag.
FIG. 5 is a cross sectional view taken along lines 5—5 of FIG. 4.
FIG. 6 is a front perspective view of the alternative embodiment of the pouch-type detergent bag.

The novel through-the washer-dryer pouch-type detergent bag will now be described by referring to FIGS. 1–3 of the drawing. The pouch-type detergent bag is generally designated numeral 10. It has a front panel 12 and a rear panel 14. Each of these panels has a top edge 16, a bottom edge 17, a left edge 18 and a right edge 19. A heat seal seam 22 is formed along three edges of detergent bag 10.

An inner chamber 24 is formed in the interior of detergent bag 10 and it has a total volume $V_T$. Chamber 24 has a length L1, a height H1 and a width W1. L1 is in the range of 2.5"–6", H1 is in the range of 2.5"–6" and W1 is in the range of 0.5"–2.5". The panels of the detergent bag 10 are made of an air and water permeable material having openings in the range of 0.2 mm–2.0 mm and have thickness T1 that is in the range of 2.0 mm–8.0 mm.

A predetermined weight and volume of granular detergent particulate 26 is located in chamber 24. The size of the detergent particulate is in the range of 5–250 microns and the total weight of the detergent particulate is in the range of 1–8 ounces. H2 is the height of the portion of chamber 24 that only contains air. H3 is the height of the portion of chamber 24 that contains the detergent particulate 26. The volume of the detergent particulate is in the range of 0.40 $V_T$–0.7 $V_T$ and the remaining air volume in chamber 24 is in the range of 0.30 $V_T$–0.60 $V_T$.

An alternative embodiment detergent bag 30 is illustrated in FIGS. 4–6. The detergent bag is generally designated numeral 30. It has two containers 29 and 31 for detergent particulate and each of these have an outer panel 32 and an inner panel 34. Each of these respective panels has a top edge 36, a bottom edge 37 a left edge 38 and a right edge 39. A heat seal seam 42 is formed along the respective top edges and left edges of the two respective containers. A web of material 44 connects the bottom edge of the respective containers to each other thereby forming an air/water passage way 46 through the interior between the two containers 29, 31 and web 44. The inner panels, outer panels and web of material are formed of an integral sheet of material and said inner panels and outer panels are impregnated with fabric softner/anti-static ingredients.

Each of the containers has an inner chamber 48, part of which is filled with detergent particulate 26. Each of the inner chambers 48 have a length L2, a height H5 and a width W2. L2 is in the range of 2.5"–6", H5 is in the range of 2.5'–6" and W2 is in the range of 0.5"–2.5". Each of the inner chambers 48 has a total volume $V_T$. The volume of the detergent particulate 26 is in the range of 0.40 $V_T$–0.70 $V_T$ and the remaining air volume in inner chambers 48 is in the range of 0.30 $V_T$–0.60 $V_T$. H6 is the height of inner chamber 48 that is filled with air and H7 is the height of the inner chamber 48 that is filled with detergent particulate.

The manner in which the detergent bags react during use will now be detailed. When the detergent bag is dropped into the water of a wash cycle of a washing machine, the bag puffs up with air that fills up the interior chamber not filled with detergent. As the washer goes through its wash cycle, the detergent bag is agitated and water permeates the interior chamber of the bag and dissolves the detergent. The water that permeates the detergent bag sloshes around within the inner chamber due to the fact its volume is not completely filled with detergent particulate and also the fact it contains a certain amount of trapped air. This allows complete dissolving of the detergent particulate and it escapes through the water permeable panels of the bag into the wash water. The escape of the air and the detergent into the wash water causes the bag to flatten. Continued agitation and spinning of the bag in the washing machine causes it to curl into a wad of material. When the wash cycle has been completed and the clothes are transferred into the dryer, the detergent bag in its wadded state is also transferred into the dryer and it is now used as an anti-static and softening sheet, that is activated by the heat in the dryer to release the fabric softening and anti-static agent and allows it to permeate the drying clothes.

What is claimed is:

1. A through-the-washer-dryer detergent bag comprising;

a pair of containers each having an inner panel and an outer panel; each of said panels being made of air and water permeable material and each of said panels having a left edge, a right edge, a top edge and a bottom edge; said respective top edges and left edges of said respective sets of inner and outer panels being sealed together adjacent their respective edges to form two containers each having an interior chamber therein having a total volume $V_T$; said chambers each having a length L2, a height H5, and a width W2; L2 is in the range of 2.5"–6", H5 is in the range of 2.5"–6", and W2 is in the range of 0.5"–2.5"; a granular detergent particulate in each of said chambers; the size of said detergent particulate being in the range of 5–250 microns and the total weight of said detergent particulate being in the range of 1–8 ounces; the volume of said particulate being in the range of 0.40 $V_T$–0.70 $V_T$, and the remaining air volume in each of said containers having a volume in the range of 0.30 $V_T$–0.60 $V_T$; and the top edges of said respective containers being sealed together and a web of material having a top surface and a bottom surface connects the respective bottom edges of said respective containers together thus forming an air and water passageway between the inner panels of said respective containers and said top surface of said web of material.

2. A detergent bag as recited in claim 1 wherein said inner and outer panels are made of nonwoven polyester material.

3. A detergent bag as recited in claim 1 wherein said respective edges of said panels are sealed together by a heat seal seam.

4. A detergent bag as recited in claim 1 wherein said inner and outer panels are impregnated with fabric softener/anti-static ingredients.

5. A detergent bag as recited in claim 1 wherein said respective inner panels, outer panels and web of material are formed of an integral sheet of material.

6. A method of providing cleaning, fabric-softening and anti-static properties to clothes which comprises:

(a) picking up a detergent bag having the following structure:

a front panel having a left edge, a right edge, a top edge and a bottom edge; said front panel being made of air and water permeable material;

a rear panel having a left edge, a right edge, a top edge and a bottom edge; said rear panel being made of air and water permeable material;

said respective left edges, right edges and top edges of said front and rear panels being sealed together adjacent their respective edges to form a container having an interior chamber therein having a total volume $V_T$; said chamber having a length L1, a height H1 and a width W1; L1 is in the range of 2.51"–6", H1 is in the range of 2.5"–6', and W1 is in the range of 0.5"–2.5"; said front and rear panels are impregnated with a fabric softener/anti-static ingredients; and a granular detergent particulate in said chamber; the size of said particulate being in the range of 5–250 microns and the total weight of said detergent particulate being in the range of 1–8 ounces; the volume of said detergent particulate being in the range of 0.40 $V_T$–0.70 $V_T$, and the remaining air volume of said chamber having a volume in the range of 0.30 $V_T$–0.60 $V_T$.

(b) dropping said detergent bag into a clothes washing machine set to a wash cycle and as said bag comes into contact with water in said clothes washing machine, said bag puffs up;

(c) agitating said detergent bag in the water during a wash cycle in said clothes washing machine causing water to permeate the interior chamber of said bag and dissolve said detergent and said dissolved detergent and air is then forced out of said chamber as said chamber collapses and said bag becomes flattened;

(d) continued agitation of said detergent bag in said washing machine causes said bag to curl up into a wad of material; and (e) transferring clothes that have finished a wash cycle along with said bag in its wadded state into a clothes dryer that heats up the wadded bag sufficiently to release its fabric softener/anti-static ingredients.

* * * * *